US010118272B2

(12) United States Patent
Tanaka et al.

(10) Patent No.: US 10,118,272 B2
(45) Date of Patent: Nov. 6, 2018

(54) METHOD FOR EVALUATING POLISHING PAD AND METHOD FOR POLISHING WAFER

(71) Applicant: SHIN-ETSU HANDOTAI CO., LTD., Tokyo (JP)

(72) Inventors: Yuki Tanaka, Nishigo-mura (JP); Kazuya Sato, Nasushiobara (JP); Syuichi Kobayashi, Shirakawa (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 189 days.

(21) Appl. No.: 14/915,756

(22) PCT Filed: Aug. 22, 2014

(86) PCT No.: PCT/JP2014/004319
§ 371 (c)(1),
(2) Date: Mar. 1, 2016

(87) PCT Pub. No.: WO2015/040795
PCT Pub. Date: Mar. 26, 2015

(65) Prior Publication Data

US 2016/0193711 A1 Jul. 7, 2016

(30) Foreign Application Priority Data

Sep. 19, 2013 (JP) ..... 2013-194400

(51) Int. Cl.
*B24B 37/00* (2012.01)
*B24B 37/005* (2012.01)
(Continued)

(52) U.S. Cl.
CPC ..... *B24B 37/005* (2013.01); *B24B 37/20* (2013.01); *B24B 49/12* (2013.01)

(58) Field of Classification Search
CPC ..... B24B 37/013; B24B 37/05; B24B 49/12; B24B 37/005
See application file for complete search history.

(56) References Cited

U.S. PATENT DOCUMENTS 5,934,974 A * 8/1999 Tzeng ..... B24B 37/013 257/E21.23
6,702,646 B1 * 3/2004 Gitis ..... B24B 49/04 451/21

(Continued)

FOREIGN PATENT DOCUMENTS

CN 100466191 C 3/2009
JP H11-260769 A 9/1999

(Continued)

OTHER PUBLICATIONS

May 22, 2017 Office Action issued in Chinese Patent Application No. 201480050581.8.

(Continued)

*Primary Examiner* — Timothy V Eley
(74) *Attorney, Agent, or Firm* — Oliff PLC

(57) ABSTRACT

The present invention provides a method for evaluating a polishing pad by which a life of a polishing pad to polish a wafer is evaluated, the method being characterized in that a quantity of polishing residues deposited on the polishing pad is measured, and the life of the polishing pad is evaluated based on a measurement value provided by the measurement. Consequently, it is possible to provide the method for evaluating a polishing pad and the method for polishing a wafer that enable immediately evaluating the life of the polishing pad and also enable suppressing a reduction in productivity and a yield ratio at the time of polishing the wafer.

8 Claims, 8 Drawing Sheets

(51) Int. Cl.
*B24B 37/20* (2012.01)
*B24B 49/12* (2006.01)

(56) References Cited

U.S. PATENT DOCUMENTS

| | | | |
|---|---|---|---|
| 2001/0026948 | A1 | 10/2001 | Nakayoshi et al. |
| 2002/0121110 | A1 | 9/2002 | Saito et al. |
| 2005/0124264 | A1 | 6/2005 | Tominaga et al. |
| 2009/0075567 | A1 | 3/2009 | Wang et al. |
| 2011/0070745 | A1 | 3/2011 | Matsui et al. |
| 2012/0064800 | A1 | 3/2012 | Watanabe et al. |

FOREIGN PATENT DOCUMENTS

| | | | |
|---|---|---|---|
| JP | 2002-150547 | A | 5/2002 |
| JP | 2003-285262 | A | 10/2003 |
| JP | 2005-169593 | A | 6/2005 |
| JP | 2011-071215 | A | 4/2011 |
| JP | 2011-143537 | A | 7/2011 |
| TW | 200914202 | A | 4/2009 |
| TW | 201221296 | A1 | 6/2012 |
| WO | 2006/049269 | A1 | 5/2006 |

OTHER PUBLICATIONS

Mar. 22, 2016 International Preliminary Report on Patentability issued in International Patent Application No. PCT/JP2014/004319.
Nov. 4, 2014 Search Report issued in International Patent Application No. PCT/JP2014/004319.
Nov. 17, 2017 Office Action issued in Chinese Patent Application No. 201480050581.8.
Sep. 20, 2017 Office Action issued in Taiwanese Patent Application No. 103129732.
Apr. 11, 2018 Office Action issued in Taiwanese Patent Application No. 103129732.

* cited by examiner

METHOD FOR EVALUATING POLISHING PAD AND METHOD FOR POLISHING WAFER

TECHNICAL FIELD

The present invention relates to a method for evaluating a life of a polishing pad and a method for polishing a wafer using this evaluation method.

BACKGROUND ART

In conventional examples, a life of a polishing pad for use in polishing of a wafer becomes clear only after the wafer actually polished with this polishing pad is cleaned, then a plurality of quality items of the wafer are monitored with the use of an inspection apparatus, and occurrence of abnormality in any quality item is detected.

As one of the quality items, for example, LPD (Light Point Defects) representing cleanliness of a surface of a wafer is used. This LPD is measured by irradiating a surface of a wafer with a laser beam and condensing reflecting light therefrom. When a particle or a COP (Crystal Original Pit) is present on the surface of the wafer, the reflecting light is irregularly reflected, and this scattered light is condensed by a photodetector to detect presence of the particle or the COP. At this time, a diameter of the particle or the COP as a measurement target is preset, and the total number of particles or COPs whose diameters are equal to or higher than the set diameter is measured. When a measurement value of this LPD exceeds a reference value serving as acceptance and rejection criteria, the life of the polishing pad is determined to have reached an end (see Patent Literature 1).

FIG. 8 shows an example of a relationship between LPD of a wafer and a use time of a polishing pad after double-side polishing. An axis of ordinate of a graph represents a value (LPD/reference value) obtained by dividing a measurement value of the LPD by a reference value serving as the acceptance and rejection criteria, and an axis of abscissa represents a use time (min) of the polishing pad. It is to be noted that the LPD was measured for three times and, for each of three times, a plurality of silicon wafers each having a diameter of 300 mm were polished by a 4-way type double-side polishing machine, the polished silicon wafers were cleaned and dried, and then the LPD was measured by Surfscan SP1 manufactured by KLA-Tencor. At this time, the number of the LPD each having a diameter of 0.2 μm or more was counted. A polyurethane foam pad (LP-57 manufactured by JH RHDES) was used as a polishing pad, and KOH alkali base colloidal silica (GLANZOX2100 manufactured by Fujimi Incorporated) was used as slurry.

It is determined that a wafer is rejected when a value of (LPD/reference value) exceeds 1, and a life of the polishing has reached an end.

CITATION LIST

Patent Literature

Patent Literature 1: Japanese Unexamined Patent publication (Kokai) No. H 11-260769

SUMMARY OF INVENTION

Technical Problem

The graph of FIG. 8 shows results of the measurement performed for three times (Samples 1-3 in FIG. 8). Even though the same type of double-side polishing machine and members are adopted in the double-side polishing performed for three times, the respective polishing pads show different lives. Since the life varies depending on each polishing pad in this manner, there is a problem that presetting the life of the polishing pad is difficult. Further, the life of the polishing pad is not clear until it is revealed from each polished wafer that the LPD has exceeded the reference value. Therefore, the polishing pad whose life has already reached an end is kept being used until inspection results of the quality items are fed back, a time or wafers that are wastefully consumed (a part surrounded by a broken line in FIG. 8) arise during this period, and there occurs a problem that productivity or a yield ratio is lowered.

In view of the above-described problem, it is an object of the present invention to provide a method for evaluating a polishing pad and a method for polishing a wafer that can immediately evaluate a life of a polishing pad and suppress a reduction in productivity and a yield ratio at the time of polishing a wafer.

Solution to Problem

To achieve this object, the present invention provides a method for evaluating a polishing pad by which a life of a polishing pad to polish a wafer is evaluated, the method being characterized in that a quantity of polishing residues deposited on the polishing pad is measured, and the life of the polishing pad is evaluated based on a measurement value provided by the measurement.

With this configuration, the life can be directly evaluated from the polishing pad, it is possible to individually determine if the life of each polishing pad has reached an end immediately after the measurement. Consequently, a waste of time and wafers that is caused by polishing using a polishing pad whose life has reached an end can be reduced, and hence a reduction in productivity and a yield ratio can be suppressed.

As this time, the quantity of polishing residue can be measured by detecting a signal including an Si—Kα line from a fluorescent X-ray spectrum provided by fluorescent X-ray spectroscopy.

With this configuration, in case of polishing a silicon wafer, checking an amount of the Si element on the polishing pad by the fluorescent X-ray spectroscopy enables further simply measuring a quantity of polishing residues.

Furthermore, at this time, it is preferable to find a linear approximate equation from the measurement value of the quantity of polishing residues with respect to a use time of the polishing pad, and to determine the use time with which a value of the linear approximate equation reaches a preset threshold value as the life of the polishing pad.

If the use time which is the life of the polishing pad is preset in this manner, polishing can be temporarily interrupted when the use time of the polishing pad has reached a predicted value, and a waste of a time or wafers caused by polishing the polishing pad that is at the end of its life can be assuredly reduced. Consequently, it is possible to further suppress a reduction in productivity or a yield ratio.

Moreover, according to the present invention, there is provided a method for polishing a wafer by which a plurality of wafers are brought into sliding contact with a polishing pad to polish the wafers, the method being characterized in that a quantity of polishing residues deposited on the polishing pad is measured before polishing, a life of the polishing pad is predicted based on a measurement value provided by the measurement, and the polishing pad is replaced at a time point that a use time of the polishing pad reaches the predicted life. Consequently, it is possible to suppress a reduction in productivity or a yield ratio.

With this configuration, the life of the polishing pad can be easily predicted. Additionally, replacing the polishing pad when the use time of the polishing pad reaches the predicted life enables reducing a waste of a time or wafers caused by polishing the wafers with the polishing pad that is at the end of its life.

At this time, the quantity of polishing residues can be measured by detecting a signal including an Si—Kα line from a fluorescent X-ray spectrum provided by fluorescent X-ray spectroscopy.

With this configuration, in case of polishing a silicon wafer, checking an amount of the Si element on the polishing pad by the fluorescent X-ray spectroscopy enables further simply measuring the quantity of polishing residues.

Further, at this time, it is preferable to find a linear approximate equation from the measurement value of the quantity of polishing residues with respect to a use time of the polishing pad, and determine the use time with which a value of the linear approximate equation reaches a preset threshold value as the life of the polishing pad.

When the life of the polishing pad is predicted in this manner, a fruitless time or rejected wafers can be assuredly decreased, and a reduction in productivity and a yield ratio can be assuredly suppressed.

Advantageous Effects of the Invention

According to the method for evaluating a polishing pad and the method for polishing a wafer of the present invention, lives of polishing pads having a considerable individual difference can be individually instantaneously evaluated, and a reduction in productivity and a yield ratio at the time of polishing wafers can be suppressed.

DESCRIPTION OF EMBODIMENTS

Although a mode for carrying out the present invention will now be described hereinafter, the present invention is not restricted thereto.

As described above, a life of a polishing pad has a large variation and is hard to predict as described above, the life of the polishing pad is indirectly checked from the quality items of polished wafers, and hence there is a problem that the life of the polishing pad is clear only after the life of the polishing pad has reached an end.

Thus, the present inventors have examined directly determining the life of the polishing pad by checking the polishing pad itself rather than the polished wafers. Consequently, the present inventors and others have turned their attention to a quantity of polishing residues deposited on the polishing pad which is said to be a cause of LPD. Further, they have conceived of individually evaluating a life of each polishing pad based on this quantity of polishing residues, thus bringing the present invention to completion.

An example of a method for evaluating a polishing pad and a method for polishing a wafer according to the present invention will now be described with reference to FIGS. 1 to 6.

The method for evaluating a polishing pad according to the present invention will be first described. Here, a description will be given as to an example of applying the method for evaluating a polishing pad according to the present invention to double-side polishing of a silicon wafer.

Figure 1:
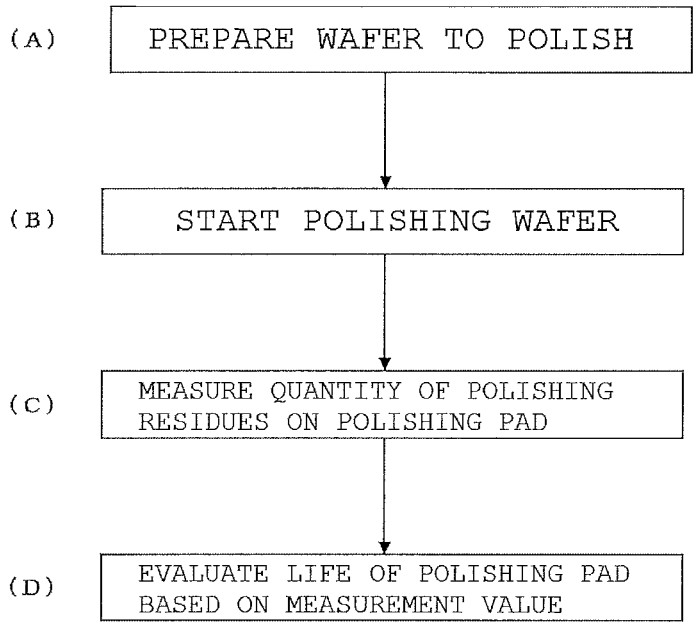
FIG. 1 is a flowchart showing an example of a method for evaluating a polishing pad according to the present invention.

First, a plurality of silicon wafers as polishing targets are prepared (A in FIG. 1). Then, a double-side polishing machine to perform double-side polishing of the silicon wafers is prepared. The double-side polishing machine used here will now be described hereinafter with reference to FIGS. 2 and 3.

Figure 2:
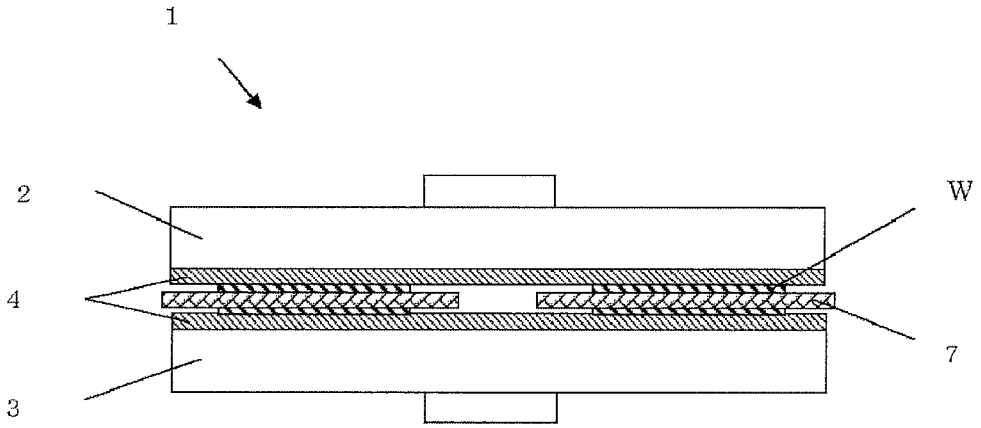
FIG. 2 is a schematic cross-sectional view showing an example of a double-side polishing machine for use in double-side polishing of a silicon wafer.
Figure 3:
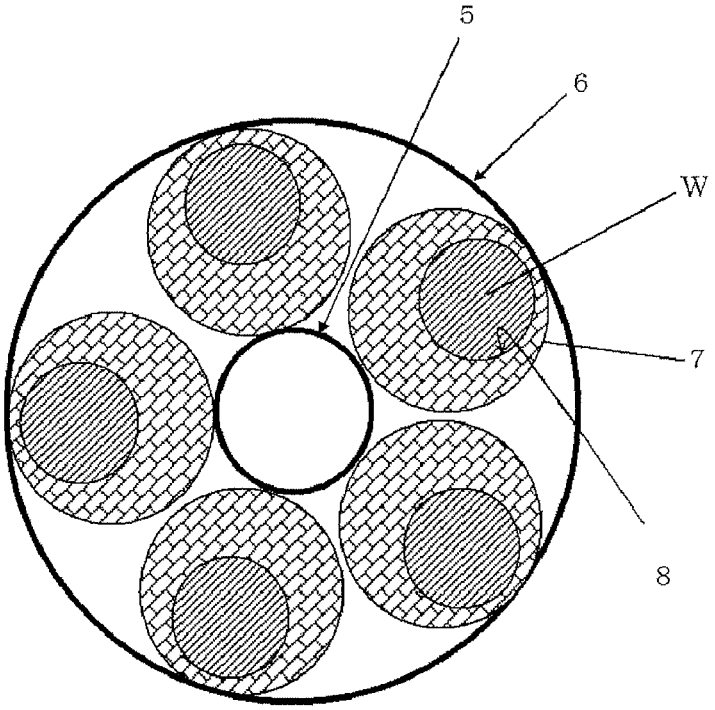
FIG. 3 is an internal block diagram of the double-side polishing machine for use in double-side polishing of a silicon wafer.

As shown in FIG. 2 and FIG. 3, a double-side polishing machine 1 includes an upper turntable 2 and a lower turntable 3 provided to vertically face each other, and polishing pads 4 are attached to them, respectively. A sun gear 5 is provided at a central portion between the upper turntable 2 and the lower turntable 3, and an internal gear 6 is provided at a peripheral edge portion. Silicon wafers W are held in holding holes 8 of carriers 7 and sandwiched between the upper turntable 2 and the lower turntable 3, respectively.

Further, respective tooth portions of the sun gear 5 and the internal gear 6 mesh with outer peripheral teeth of the carries 7, the carriers 7 evolve around the sun gear 5 while autorotating as the upper turntable 2 and the lower turntable 3 are rotated by a non-illustrated drive source. At this time, both surfaces of the silicon wafers W held in the holding holes 8 of the carriers 7 are polished by the upper and lower polishing pads 4, respectively. At the time of polishing the silicon wafers W, a polishing liquid is supplied from a non-illustrated nozzle. The above-described double-polishing is repeatedly carried out, and the plurality of silicon wafers W are subjected to the double-side polishing in batches (B in FIG. 1).

Before starting the next polishing between batches that are subjected to the double-side polishing of the silicon wafers using this polishing machine 1, a quantity of polishing residues deposited on the polishing pads 4 is measured in the present invention (C in FIG. 1). As described above, it has been revealed that the quantity of polishing residues have a correlation with the LPD. Thus, in the present invention, a life of the polishing pads is evaluated from a measurement value of the quantity of polishing residues (D in FIG. 1).

When the life is directly evaluated from the polishing pads in this manner, whether the life of the polishing pad has reached its end can be determined immediately after measuring a quantity of polishing residues.

For example, in case of the polishing pads 4 of this double-side polishing machine 1, a quantity of polishing residues can be measured between batches of the double-side polishing. As a measuring method, the fluorescent X-ray spectroscopy can be used. According to the fluorescent X-ray spectroscopy, since an easy-to-carry handheld type X-ray fluorescence spectrometer can be used, measurement can be simply performed in a short time with the polishing pads being attached to the turntables.

To measure the quantity of polishing residues based on the fluorescent X-ray spectroscopy, the following method is specifically taken.

When the silicon wafers W have been subjected to the double-side polishing, since the polishing residues deposited on the polishing pads 4 contain an Si element, detecting a signal including an Si—Kα line of a fluorescent X-ray spectrum enables measuring a quantity of polishing residues. More specifically, a value found by integrating a quantity of signals in the range of 1.6 to 1.9 eV including the Si—Kα signal from the detected fluorescent X-ray spectrum can be used as a standard value of the quantity of polishing residues (this standard value for the quantity of polishing residues will be referred to as a quantity of Si signals hereinafter). It is desirable to wipe off moisture on surfaces of the polishing pads with, e.g., a dry cloth before the measurement.

A result of an examination of the correlation between the quantity of Si signals and the LPD conducted by the present inventions and others will now be described hereinafter.

Figure 4:
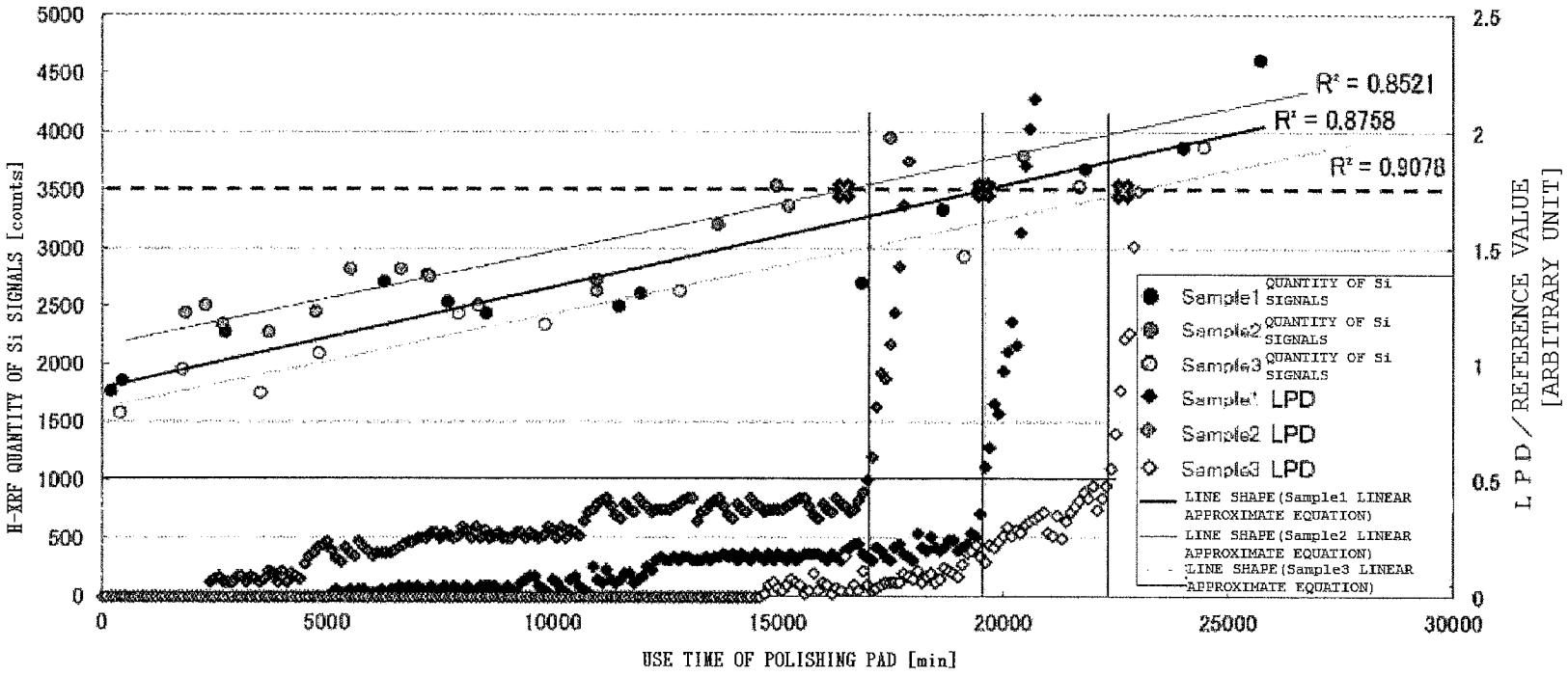
FIG. 4 is a view showing a correlation of a quantity of Si signals and LPD.
Figure 5:
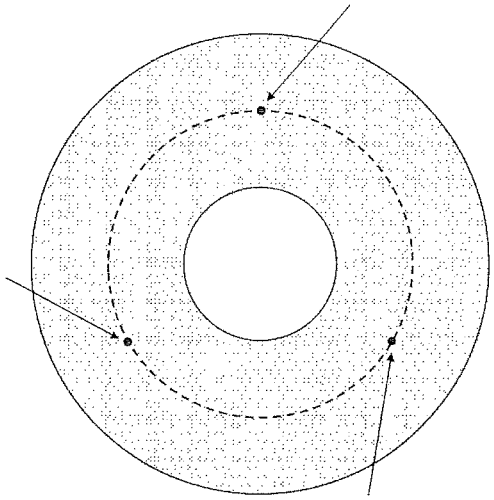
FIG. 5 is a view showing an example of positions where a quantity of Si signals is measured on the polishing pad.
Figure 8:
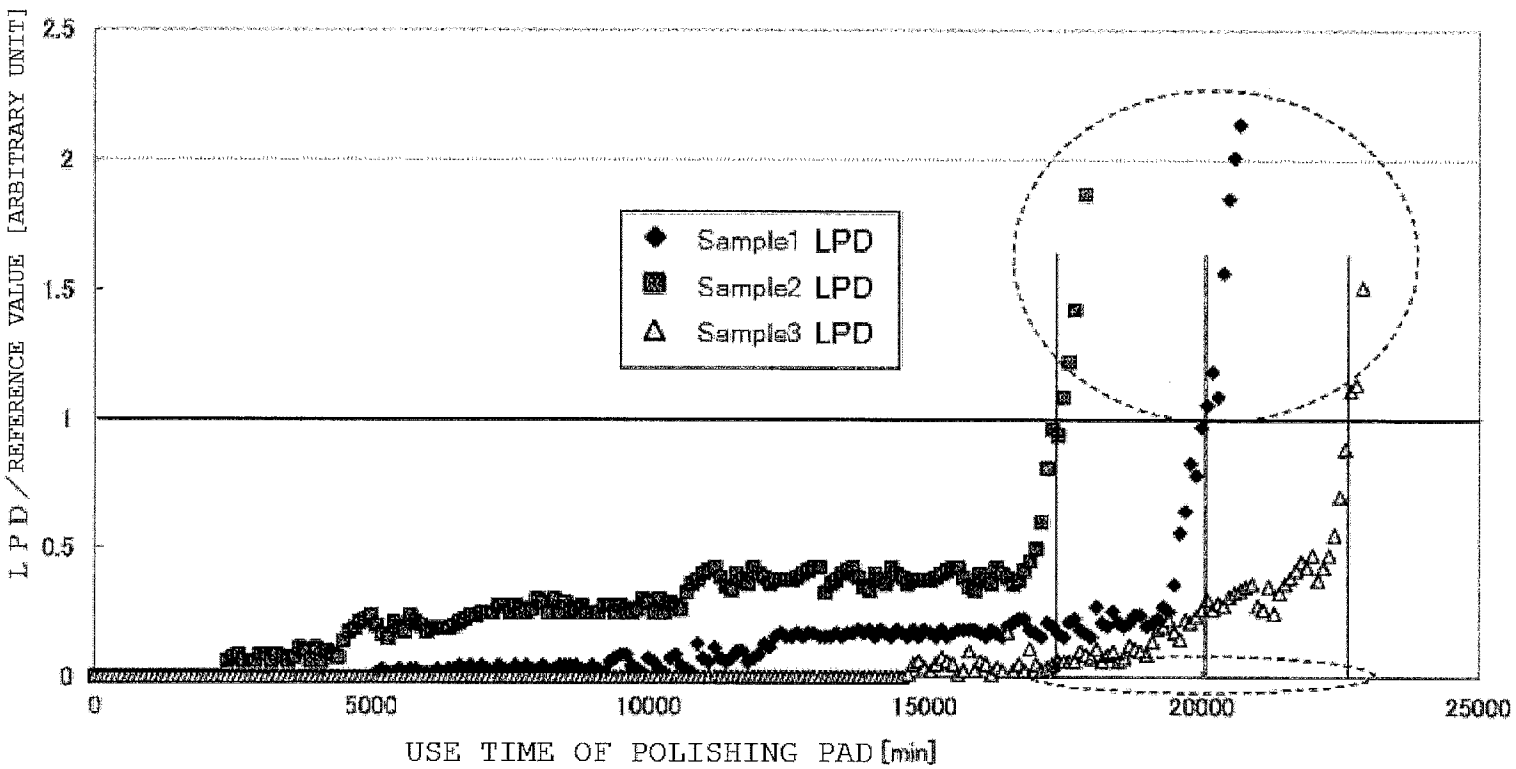
FIG. 8 is a view showing a relationship between a use time of the polishing pad and LPD.

FIG. 4 is a graph showing measurement results of quantities of Si signals provided by measuring the quantities of Si signals as well as the measurement of the LPD depicted in FIG. 8. For the measurement of the quantities of Si signals, MESA-630 manufactured by Horiba Ltd. was used. A measurement recipe was Alloy LE FP, and an X-ray irradiation time was 60 seconds. A quantity of Si signals of the polishing pad attached to the lower turntable of the double-side polishing machine was measured, the measurement was performed at three points (positions indicated by arrows in FIG. 5) on a circle provided at equal intervals from a circumference of an inner circle and a circumference of an outer circle of the polishing pad, and average values of measurement values of the quantities of Si signals at the three points were plotted in FIG. 4.

As shown in FIG. 4, the quantity of Si signals increases with a use time of the polishing pad like the LPD, and it can be understood from this fact that the quantity of Si signals and the LPD has a correlation. Thus, the life of the polishing pad can be evaluated by measuring the quantity of polishing residues from the quantity of Si signals.

In case of evaluating the life of the polishing pad from the quantity of Si signals, a threshold value of the quantity of Si signals is preset, and the life of the polishing pad can be determined to have reached an end when the quantity of Si signals becomes the threshold value or more. For example, when a value of (LPD/reference value) is 0.5 in FIG. 4, a value of the quantity of Si signals is approximately 3500 in any sample (x marks in FIG. 4). Thus, when the threshold value of the quantity of Si signals is set to 3500 in advance and a time point when the quantity of Si signals reaches 3500 is determined as the life of the polishing pad, a waste of time or wafers can be decreased, and a reduction in productivity or a yield ratio can be suppressed.

Moreover, it is preferable to determine a predetermined use time of the polishing pad as the life based on a measurement value of the quantity of polishing residues in advance. A description will now be given as to a procedure of specifically determining a use time as the life of each polishing pad in an example of measuring a quantity of polishing pad by measuring a quantity of Si signals.

First, a quantity of Si signals is measured from the polishing pad based on the fluorescent X-ray spectroscopy for a plurality of number of times. Additionally, a linear approximate equation for the use time of the polishing pad is found from a plurality of measurement values of the quantity of Si signals. It is preferable to perform the measurement for a plurality of number of times when the use time of the polishing pad is 5000 min or less. Further, considering an accuracy of prediction based on the linear approximate expression, it is preferable to perform the measurement for five times or more. Furthermore, a use time of the polishing pad with which a value of the found linear approximate expression reaches the threshold value is determined as the life of the polishing pad.

Figure 6:
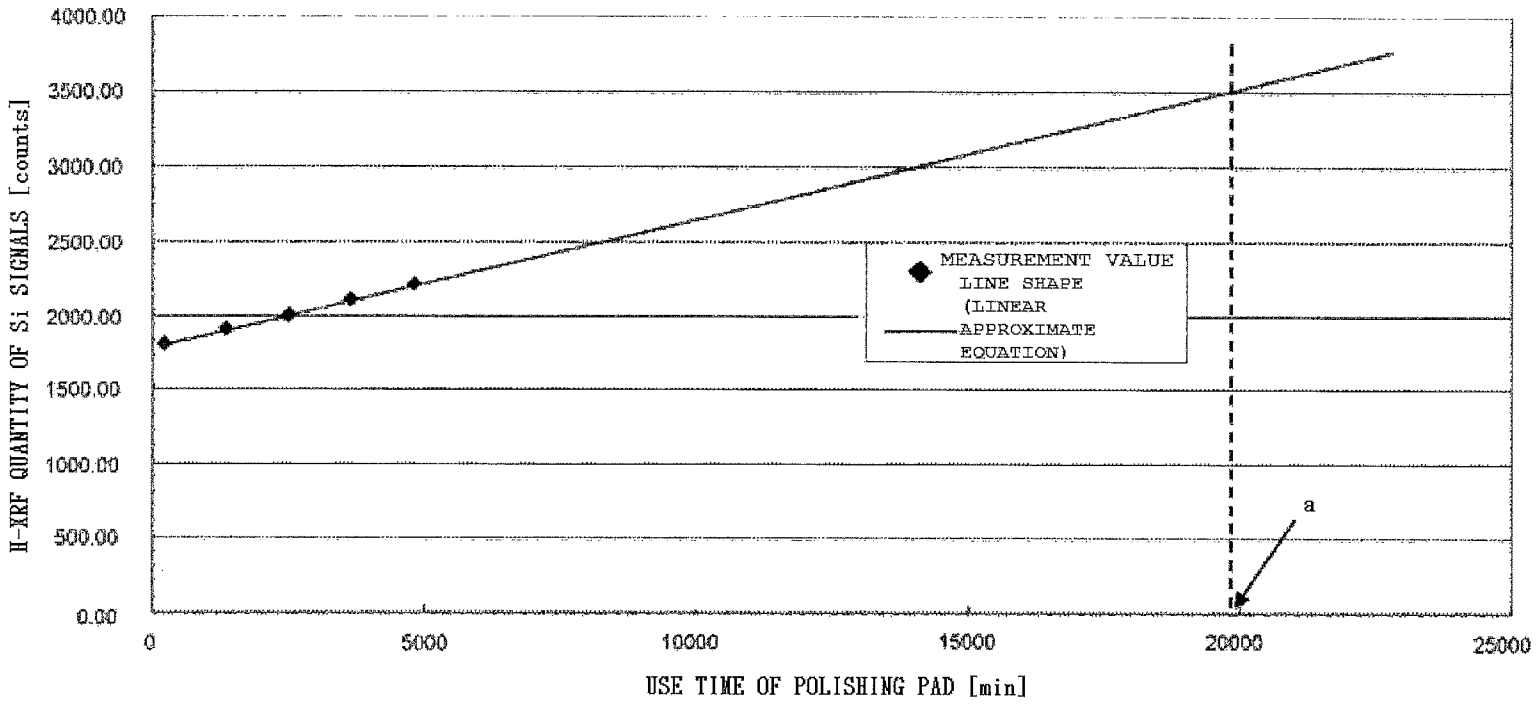
FIG. 6 is a view showing an example of a linear approximate equation in the method for evaluating a polishing pad according to the present invention.

A graph of FIG. 6 shows a straight line represented by a linear approximate expression found from measurement values of a quantity of Si signals with respect to use times of the polishing pads. An axis of ordinate of the graph represents the quantity of Si signals, and an axis of abscissa represents the use time of the polishing pad. Here, a threshold value of the quantity of Si signals is determined as 3500, and the quantity of Si signals is measured for five times when the use time of the polishing pad is 5000 min or less. Further, the linear approximate equation is found from these measurement values. As shown in FIG. 6, approximately 20000 min with which a value of the linear approximate equation reaches 3500 as the threshold value is determined as the life of the polishing pad (a point indicated by a in FIG. 6). Furthermore, when the threshold value of the quantity of Si signals is set to approximately 3500, it is possible to prevent the use time of the polishing pad from exceeding the life due to an error, thereby suppressing production of a rejected silicon wafer.

As described above, when the use time is preset as the life of the polishing pad based on the measurement values of the quantity of polishing residues, the polishing can be temporarily interrupted immediately before the polishing pad reaches its end, and a waste of time or wafers caused due to polishing using the polishing pad that is at the end of its life. Consequently, a reduction in productivity and a yield ratio can be further assuredly suppressed.

A method for polishing a wafer according to the present invention will now be described. Here, a description will be given as to an example where the method for polishing a wafer according to the present invention is applied to the double-side polishing of a silicon wafer.

First, a plurality of silicon wafers to be subjected to the double-side polishing are prepared. Then, the double-side polishing of the plurality of silicon wafers is performed in batches by using the double-side polishing machine 1. At this time, a quantity of polishing residues deposited on the polishing pad is measured between the batches for the polishing of the silicon wafers, i.e., after end of the polishing of a previous batch and before the polishing of a subsequent batch.

As a method for measuring a quantity of polishing residues, it is possible to use a method for detecting a signal including an Si—Kα line of a fluorescent X-ray spectrum provided by the fluorescent X-ray spectroscopy. According to the fluorescent X-ray spectroscopy, since an easy-to-carry handheld type X-ray fluorescence spectrometer can be used, measurement can be simply performed in a short time with the polishing pads being attached to the turntables.

After measuring the quantity of polishing residues, a life of each polishing pad is predicted based on the measurement value. Here, a description will be given as to a procedure of specifically predicting a life of each polishing pad in an example of measuring a quantity of polishing residues by measuring a quantity of Si signals.

First, a quantity of Si signals is measured from the polishing pad based on the fluorescent X-ray spectroscopy for a plurality of number of times. Additionally, a linear approximate equation for a use time of the polishing pad is found from a plurality of measurement values of the quantity of Si signals. It is preferable to perform the measurement for a plurality of number of times when the use time of the polishing pad is 5000 min or less. Further, considering an accuracy of prediction based on the linear approximate expression, it is preferable to perform the measurement for five times or more. Further, the use time of the polishing pad with which a value of the found linear approximate equation reaches the threshold value is predicted as the life of the polishing pad. Predicting the life of the polishing pad by using the linear approximate equation in this manner enables performing an accurate prediction, thereby further assuredly suppressing a reduction in productivity and a yield ratio.

Then, the polishing pad is replaced when the use time of the polishing pad reaches the predicted life.

According to the above-described method for polishing a wafer, the life of the polishing pad can be easily predicted. Furthermore, when the polishing pad is replaced when the use time of the polishing pad reaches the predicted life, it is possible to reduce a waste of time or wafers caused by polishing the wafers with the polishing pad that is at the end of its life. Consequently, a reduction in productivity and a yield ratio can be suppressed.

In the example of the method for evaluating a polishing pad and the method for polishing a wafer, a case where the silicon wafer is subjected to the double-side polishing has been described, but the present invention is not restricted to this case as a matter of course. A wafer to be polished may be a wafer such as an SiC wafer or a compound semiconductor wafer besides the silicon wafer. The present invention can be applied to the polishing method for not only the double-side polishing but also single-side polishing.

EXAMPLES

The present invention will now be more specifically described hereinafter based on examples and a comparative example, but the present invention is not restricted thereto.

Example 1

A life of a polishing pad was evaluated based on the method for evaluating a polishing pad according to the present invention.

In Example 1, a polishing pad in case of performing double-side polishing to a plurality of silicon wafers each having a diameter of 300 mm in batches by such a 4-way double-side polishing machine as shown in FIGS. 2 and 3 was determined as an evaluation target. The polishing pad was a polyurethane foam pad (LP-57 manufactured by JH RHODES), and slurry was KOH alkali base colloidal silica (GLANZOX2100 manufactured by Fujimi Incorporated), and each carrier holding the silicon wafer had titanium as its base material, and an insert material was an aramid resin.

Figure 7:
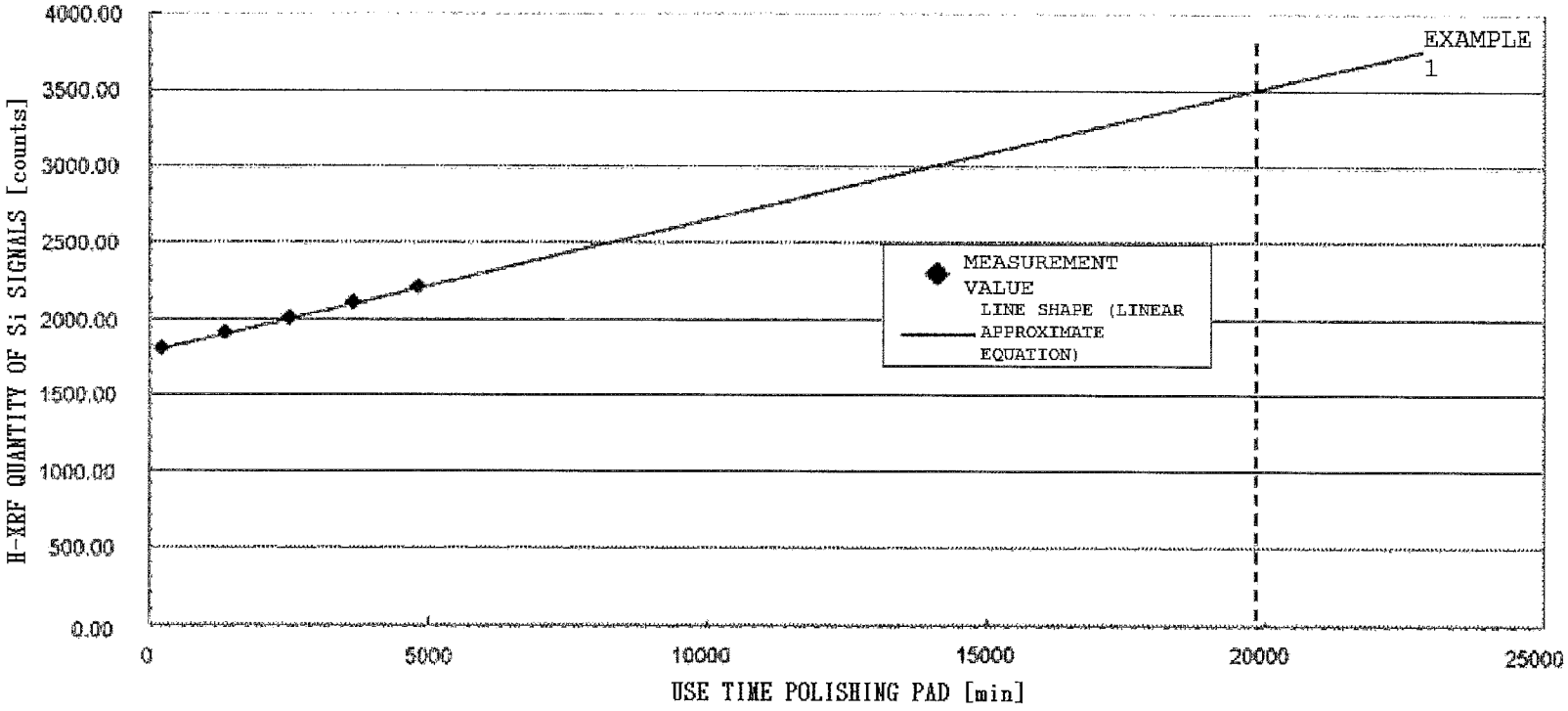
FIG. 7 is a view showing a linear approximate equation obtained from quantities of Si signals in Example 1.

Moreover, a quantity of polishing residues was measured by measuring a quantity of Si signals for five times when a use time of the polishing pad was 5000 min or less. Then, a linear approximate equation was found from these measurement values, and the use time of the polishing pad with which a value of the linear approximate equation became 3500 was determined as a predicted value of a life. FIG. 7 shows a straight line representing the linear approximate equation obtained in this Example 1.

Furthermore, after cleaning/drying each silicon wafer subjected to the double-side polishing, LPD on its surface was measured by Surfscan SP1 manufactured by KLA-Tencor. At this time, a set particle diameter was 0.2 μm or more, and an edge exclusion area was 3 mm. A use time (a conventional value) of the polishing pad when the thus measured LPD exceeded a reference value for acceptance and rejection of wafers was compared with the predicted value of the life, and an accuracy of the predicted value of the life was examined.

In Example 1, the above-described process was carried out for five times (Measurement 1-5 in Table 1). Table 1 shows a result.

As shown in Table 1, comparing the predicted value of the life with a conventional value, it can be understood that the life can be predicted within a standard error of 7%.

Thus, according to the method for evaluating a polishing pad of the present invention, it was confirmed that the life of the polishing pad can be accurately predicted and a reduction in productivity and a yield ratio can be suppressed. Likewise, it can be understood that, even if each wafer is polished based on the method for polishing a wafer of the present invention, a reduction in productivity and a yield ratio can be suppressed.

Example 2

A life of a polishing pad was evaluated under the same conditions as Example 1. Moreover, the life of the polishing pad was evaluated under the same conditions as Example 1. However, in Example 2, LPD on a surface of each polished wafer was not measured, but a quantity of Si signals of the polishing pad alone was periodically measured. Additionally, polishing was interrupted when a measurement value of the quantity of Si signals exceeded 3500.

Consequently, it was possible to suppress production of rejected wafers caused by performing double-side polishing to silicon wafers with the use of a polishing pad that was at the end of its life. Thus, as compared with a later-described comparative example, a reduction in productivity and a yield ratio was suppressed.

Comparative Example

A life of a polishing pad was evaluated under the same conditions as Example 1 except that polishing residues were not measured. Further, LPD on a surface of each polished silicon wafer was measured by the same method as Example 1.

Consequently, when it was found out that a measurement value of LDP exceeded a reference value, the double-side polishing was performed to the silicon wafers in several batches with the use of the polishing pad that was at the end of its life, and rejected wafers were produced. Thus, as compared with Examples 1 and 2, productivity and a yield ratio were greatly lowered.

Table 1 shows an outline of implementation results in Examples and Comparative Example.

TABLE 1

| Pad | Conventional value | Predicted value | Error [%] |
|---|---|---|---|
| Measurement 1 | 20570 | 18650.82 | −9.33 |
| Measurement 2 | 17890 | 16480.27 | −7.88 |
| Measurement 3 | 22320 | 22965.05 | 2.89 |
| Measurement 4 | 19840 | 18508.74 | −6.71 |
| Measurement 5 | 18760 | 17763.84 | −5.31 |
| | | Standard error | 6.69 |

It is to be noted that the present invention is not restricted thereto. The foregoing embodiment is an illustrative example, and any example that has substantially the same configuration and exerts the same functions and effects as the technical concept described in claims of the present invention is included in the technical scope of the present invention.

The invention claimed is:

1. A method for evaluating a polishing pad by which a life of a polishing pad to polish a wafer is evaluated, wherein a quantity of polishing residues from at least one wafer deposited on the polishing pad is measured, and the life of the polishing pad is evaluated based on a measurement value provided by the measurement.

2. The method for evaluating a polishing pad according to claim 1, wherein the quantity of polishing residue is measured by detecting a signal including an Si-Kα line from a fluorescent X-ray spectrum provided by fluorescent X-ray spectroscopy.

3. The method for evaluating a polishing pad according to claim 2, wherein a linear approximate equation is found from the measurement value of the quantity of polishing residues with respect to a use time of the polishing pad, and the use time with which a value of the linear approximate equation reaches a preset threshold value is determined as the life of the polishing pad.

4. The method for evaluating a polishing pad according to claim 1, wherein a linear approximate equation is found from the measurement value of the quantity of polishing residues with respect to a use time of the polishing pad, and the use time with which a value of the linear approximate equation reaches a preset threshold value is determined as the life of the polishing pad.

5. A method for polishing a wafer by bringing a plurality of wafers into sliding contact with a polishing pad, wherein a quantity of polishing residues from at least one wafer deposited on the polishing pad is measured before polishing, a life of the polishing pad is predicted based on a measurement value provided by the measurement, and the polishing pad is replaced at a time point that a use time of the polishing pad reaches the predicted life.

6. The method for polishing a wafer according to claim 5, wherein the quantity of polishing residues is measured by detecting a signal including an Si-Kα line from a fluorescent X-ray spectrum provided by fluorescent X-ray spectroscopy.

7. The method for polishing a wafer according to claim 6, wherein a linear approximate equation is found from the measurement value of the quantity of polishing residues with respect to a use time of the polishing pad, and the use time with which a value of the linear approximate equation reaches a preset threshold value is determined as the life of the polishing pad.

8. The method for polishing a wafer according to claim 5, wherein a linear approximate equation is found from the measurement value of the quantity of polishing residues with respect to a use time of the polishing pad, and the use time with which a value of the linear approximate equation reaches a preset threshold value is determined as the life of the polishing pad.

* * * * *